US007340206B2

(12) United States Patent
Takiguchi

(10) Patent No.: US 7,340,206 B2
(45) Date of Patent: Mar. 4, 2008

(54) IMAGE FORMING APPARATUS WITH A LOOP BELT TRANSFERRING A RECORDING MEDIUM

(75) Inventor: Toshiki Takiguchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 300 days.

(21) Appl. No.: 11/195,608

(22) Filed: Aug. 3, 2005

(65) Prior Publication Data

US 2006/0029440 A1 Feb. 9, 2006

(30) Foreign Application Priority Data

Aug. 6, 2004 (JP) ..... 2004-231599

(51) Int. Cl.
*G03G 15/01* (2006.01)
*G03G 15/20* (2006.01)

(52) U.S. Cl. ..... 399/302; 399/303; 399/329; 399/333

(58) Field of Classification Search ..... 399/302, 399/303, 329, 333
See application file for complete search history.

(56) References Cited

U.S. PATENT DOCUMENTS

| | | | | |
|---|---|---|---|---|
| 6,418,287 | B1 * | 7/2002 | Jackson | 399/303 |
| 6,505,028 | B1 * | 1/2003 | Yoda et al. | 399/329 |
| 7,085,523 | B2 * | 8/2006 | Fujita et al. | 399/302 |

FOREIGN PATENT DOCUMENTS

| | | |
|---|---|---|
| JP | 2001-96551 | 4/2001 |
| JP | 2002-318505 | 10/2002 |

* cited by examiner

*Primary Examiner*—William J. Royer
(74) *Attorney, Agent, or Firm*—Nixon & Vanderhye, P.C.

(57) ABSTRACT

A loop belt of an image forming apparatus is formed by splicing belt members made of different materials in a width direction of the loop belt.

12 Claims, 8 Drawing Sheets

IMAGE FORMING APPARATUS WITH A LOOP BELT TRANSFERRING A RECORDING MEDIUM

CROSS-REFERENCE TO RELATED APPLICATIONS

This Nonprovisional application claims priority under 35 U.S.C. §119(a) on Patent Application No. 2004-231599 filed in Japan on Aug. 6, 2004, the entire contents of which are hereby incorporated by reference.

BACKGROUND OF THE INVENTION

1. Field of the Invention

This invention relates to an image forming apparatus that forms an image, which is based on image data, on a recording medium that is transferred by a loop belt.

2. Description of Related Art

An image forming apparatus, such as a copier or printer, has loop belts arranged in respective sections, so that a recording sheet is carried properly from a containing section, in which recording sheets are stored, to an ejecting section, to which a recording sheet forming an image based on image data is ejected, using the loop belts. Such a loop belt is, for example, employed for a process unit that forms an electrostatic latent image, which is based on the image data obtained from the outside, on a photosensitive drum and develops the latent image into a developed image, using a developer, and for a transfer unit that transfers the developed image formed on the photosensitive drum to a sheet, and for a fixing unit that fixes the transferred image to the sheet.

Recently, a color image forming apparatus using an intermediate transfer method has been in practice. According to the intermediate transfer method, developed images based on image data of a plurality of hues are formed on photosensitive drums corresponding to respective hues, and the developed images of respective hues are layered on an intermediate transfer body, then the layered developed images having respective hues are transferred all together again from the intermediate transfer body to a sheet. A loop belt is also used in such an application as the intermediate transfer body, and the color image forming apparatus like this enables a faster image forming process.

The loop belt as described above is stretched between a plurality of rollers, including a driving roller, and is driven by the driving roller to run in rotation. The loop belt, therefore, may meander as it is given a specific tensile force in the course of rotation. Since a loop belt used for an image forming apparatus works in a process where positional precision is essential, such as a process of transferring or fixing a developed image on a photosensitive drum to a sheet, preventing the meandering of the loop belt is an absolute necessity.

There is an apparatus that employs one method of preventing the meandering of a loop belt. According to the method, the loop belt has recessions along both edges thereof, where the recessions extend in parallel with the running direction of the loop belt, and rollers, over which the loop belt is stretched, are provided with bias stoppers, such as ribs, on both ends thereof (See Japanese Patent Application Laid-Open No. 2001-96551). By fitting the bias stoppers on the rollers into the recessions of the loop belt as the rollers rotate, the loop belt is prevented from meandering while it runs.

Since a loop belt used for an image forming apparatus runs in rotation in a stretched manner, it must be made of a material showing superior bendability. Besides, the loop belt carries a recording sheet or a developed image transferred to the loop belt from a photosensitive drum, both are held on the loop belt, according to a location where the loop belt is arranged in the image forming apparatus. Because of this, the loop belt is made of material that has an electric resistance according to a given location of arrangement (for example, $1\times10^{6}$ to $1\times10^{13}\Omega$ cm or so).

Conventionally, the loop belt rotates as many times as the image forming apparatus executes image processes, and is subjected to a number of electric fields generated by voltages that are applied to the loop belt according to a given location. As a result, the bending capability of the loop belt declines due to continuous rotations, and both edges of the loop belt, which are parallel with its running direction, deteriorates heavily as well.

Meanwhile, in forming a static latent image based on image data on a photosensitive drum, an electrifier is used to electrify the surface of the photosensitive drum. A charger-type electrifier is in popular use, because it costs less in comparison with a roller-type and a brush-type. The charger-type electrifier, however, generates more ozone than the roller-type or brush-type does when the charger-type electrifier electrifies the photosensitive drum.

In addition, the loop belt deteriorates not only due to a rotation load applied by itself, but also to damage to a belt material by ozone that is generated by an applied voltage to the photosensitive drum. The damage to the belt material by the ozone concentrates particularly on both edges of the loop belt that are parallel with its running direction. When the ozone damages the material of the stretched loop belt that runs in rotation under a given tense condition, both edges of the loop belt may yield to an applied tensile force to crack. This concern becomes graver when using a charger-type electrifier.

In an image forming apparatus, a sheet is held and carried at a center portion of a loop belt having a width greater than that of the sheet. As the sheet is carried in this manner, the sheet is electrified via the loop belt to transfer a developed image formed on a photosensitive drum to the sheet. In the transfer process, the area occupied by the sheet held on the surface of the loop belt comes in contact with the photosensitive drum via the sheet, but the area of both sides of the occupied sheet comes in direct contact with the photosensitive drum, allowing the voltage corresponding to the charged electric potential of the loop belt to be applied to the photosensitive drum. This means that a high voltage is applied to the area other than an area for forming a static latent image on the photosensitive drum, that is, to the area on the photosensitive drum that corresponds to the outside of the area on the loop belt where the sheet is held and carried. The high voltage applied to such an area on the photosensitive drum causes it to deteriorate.

BRIEF SUMMARY OF THE INVENTION

According to the above description, it is an object of this invention to make a loop belt, which carries a recording medium on which an image based on image data obtained from the outside is formed, have different characteristics widthwise and to provide an image forming apparatus that uses the loop belt having functions according to respective characteristics.

It is another object of the present invention to make the loop belt, which is used for the image forming apparatus, have different characteristics in the lateral center and both sides of the belt, and to provide an image forming apparatus that uses the loop belt having functions according to respective characteristics.

It is still another object of the invention to make respective center portions of a plurality of the loop belts, which are arranged between a containing section storing a recording medium and an ejecting section to which a recording medium bearing a formed image is ejected, out of different materials according to respective locations of arrangement of the loop belts, and to provide the image forming apparatus that uses the loop belts each made by splicing the center portion, which have a characteristic required for each location of arrangement, to both end portions, which have superior durability, in the width direction.

The image forming apparatus related to the present invention has a loop belt for carrying a recording medium and an image forming section that forms an image, which is based on the image data obtained from the outside, on the recording medium carried on the loop belt, wherein the loop belt is formed by splicing belt members made of different materials in the width direction thereof.

According to the present invention, the loop belt is formed by splicing the belt members made of different materials in the width direction to give the loop belt different characteristics widthwise for use in the image forming apparatus, which forms an image, which is based on obtained external image data, on the recording medium transferred by the loop belt. Thus the loop belt having the functions according to respective characteristics can be used in the image forming apparatus.

The image forming apparatus related to the present invention, the loop belt is spliced as a first belt member, which is provided in the center of the width direction thereof, and second belt members, which are provided on both sides of the first belt member in the width direction and are made of a material different from that of the first belt member.

According to the present invention, the loop belt is formed by splicing the first belt member, which is formed in the lateral center of the loop belt, to the second belt members, which are formed on both lateral sides of the first belt member and made of a material different from that of the first belt member. This gives the loop belt different characteristics in the lateral center and on both sides of the center, thus the loop belt having the functions according to respective characteristics can be used in the image forming apparatus. For example, a loop belt with both lateral ends made of a material highly resistant to ozone is available for use in the image forming apparatus.

The image forming apparatus related to the present invention, the first belt member has a width greater than that of the recording medium carried by the loop belt.

According to the present invention, the first belt member having the width greater than that of the transferred recording medium offers the loop belt that carries the recording medium surely and precisely for use in the image forming apparatus.

The image forming apparatus related to the present invention, the second belt members are made of a material that shows bending crack resistance and ozone resistance superior to that of the first belt member.

According to the present invention, by making the second belt members out of the material showing bending crack resistance and ozone resistance superior to that of the first belt member, the deterioration of the loop belt that leads to a crack formation on both lateral ends is prevented when the stretched loop belt runs in rotation under a given tense condition in an ozonic environment, thus such a loop belt is provided for the image forming apparatus.

The image forming apparatus related to the present invention, a plurality of the loop belts are provided between a containing section that contains a recording medium and an ejecting section that ejects the recording medium on which is formed an image, and the first belt member of each loop belt is made of each different material according to the location of the alignment of the loop belt.

According to the present invention, the first belt member of each loop belt is made of each different material according to the location of arrangement of the loop belt in the image forming apparatus, which has the loop belts that are arranged between the containing section that contains the a recording medium and the ejecting section to which the recording medium carrying a formed image is ejected. Each section of the image forming apparatus, therefore, can be operated highly precisely, using the loop belts having the required characteristics for respective locations of arrangement of the loop belts.

The image forming apparatus related to the present invention includes an image forming section that forms an image, which is created by a developer electrified on the basis of obtained external image data, on an image member, a transfer section that transfers the image on the image member, which is formed at the image forming section, to the recording medium, and an electrifying section that electrifies the loop belt that carries the recording medium to which the image is transferred at the transfer section, wherein the first belt member of the loop belt is made of a material that has an electric resistance enabling the first belt member to hold the recording medium when the belt member is electrified.

According to the present invention, the image, which is created by the developer electrified on the basis of image data obtained from the outside, is formed on the image member, and the loop belt that carries the recording medium, to which the image on the image member is transferred, is electrified, then the image on the image member is transferred to the recording medium that is electrified via the loop belt. In the image forming apparatus, the first belt member of the loop belt is made of the material that has an electric resistance enabling the first belt member to hold the recording medium when the belt member is electrified, thus providing a loop belt capable of holding the carried recording medium for use in the image forming apparatus.

The image forming apparatus related to the present invention includes a first transfer section that transfers the image on the image member, which is formed at the image forming section, to a primary transfer member, a second transfer section that transfers the image transferred to the primary transfer member at the first transfer section to the recording medium, and an electrifying section that electrifies the primary transfer member to which the image is transferred at the first transfer section, wherein the primary transfer member is the loop belt, whose first belt member is made of a material that has an electric resistance enabling the first belt member to hold the image on the image member when the belt member is electrified.

According to the present invention, the image created by the developer electrified on the basis of obtained image data from the outside is formed on the image member, and the primary transfer material, to which the image on the image member is transferred, is electrified, then the image transferred to the electrified primary transfer material is transferred further to the recording medium. In the image forming apparatus, the first belt member of the loop belt working as the primary transfer material is made of the material that has the electric resistance enabling the first belt member to hold the image on the image member when the belt member is electrified, thus providing the loop belt as the primary transfer member, which can hold the image transferred from the image member, for use in the image forming apparatus.

The image forming apparatus related to the present invention includes a transfer section that transfers the image on the image member, which is formed at the image forming section, to the recording medium, a fixing section that fixes the image transferred at the transfer section to the recording medium, and an electrifying section that electrifies the loop belt that carries the recording medium to which the image is fixed at the fixing section, wherein the first belt member of the loop belt is made of a material that has an electric resistance enabling the first belt member to hold the recording medium when the belt member is electrified.+

According to the present invention, the image created by the developer electrified on the basis of obtained image data from the outside is formed on the image member, and the loop belt that transfers the recording medium, to which the image on the image member is transferred and then fixed, is electrified, then the transferred image is fixed to the recording medium that is electrified via the loop belt. In the image forming apparatus, the first belt member of the loop belt is made of a material that has an electric resistance enabling the first belt member to hold the recording medium when the belt member is electrified, thus providing a loop belt cap able of holding the recording medium, to which the transferred image is fixed, for use in the image forming apparatus.

The image forming apparatus related to the present invention, wherein the loop belt is formed of the belt members made of different materials that are fused and spliced together.

According to the present invention, the loop belt is formed by fusing and splicing together the belt members made of different materials, which enables the precise formation of the loop belt in a conventional melt-splicing process.

In the present invention, the loop belt, which carries the recording medium on which the image based on obtained data from the outside is formed, is formed by splicing the belt members made of different materials in the width direction. The loop belt, therefore, possesses different characteristics widthwise, thus having the functions according to respective characteristics for use in the image forming apparatus.

In the present invention, the loop belt used in the image forming apparatus is formed by splicing the first belt member, which is formed in the lateral center of the belt, to the second belt members, which are formed on both lateral sides of the first belt member and made of a material different from that of the first belt member. This gives the loop belt different characteristics in the lateral center and both sides of the center, thus offering a loop belt having functions according to respective characteristics for use in the image forming apparatus. For example, when both lateral ends of the loop belt are made of a material highly resistant to ozone, the loop belt has high durability at both lateral ends, and is available for the image forming apparatus.

In the present invention, the first belt member of the loop belt has the width greater than that of the recording medium on transfer, thus offering a loop belt that carries the recording medium surely and precisely for use in the image forming apparatus. In addition, when the second belt members are made of a material showing bending crack resistance and ozone resistance superior to that of the first belt member, the deterioration of the loop belt that leads to a crack formation on both lateral ends is prevented when the stretched loop belt runs in rotation under a given tense condition in an ozonic environment. Thus such a loop belt that hardly deteriorates can be used in the image forming apparatus. The life of the loop belt, therefore, is extended to reduce the costs of consumables used for the image forming apparatus.

In the present invention, a plurality of the loop belts are arranged between the containing section that contains a recording medium and the ejecting section to which the recording medium carrying a formed image is ejected, and the first belt member of each loop belt is made of each different material according to the location of arrangement of the loop belt. This gives the loop belt the characteristics required for each location of arrangement, and such a loop belt enables each section of the image forming apparatus to operate highly precisely.

For example, the first belt member of the loop belt, which transfers the recording medium, to which the image created on the image member by the developer on the basis of obtained image data from the outside is transferred, is made of the material that has the electric resistance enabling the loop belt to hold the recording medium when the loop belt is electrified. This makes the loop belt, capable of holding the carried recording medium firmly, available for the image forming apparatus. Also, according to the image forming apparatus, in which the image created by the developer on the image member on the basis of obtained image data from the outside is transferred to the primary transfer material and is transferred further to the recording medium, the first belt member of the loop belt working as the primary transfer material is made of the material that has the electric resistance enabling the loop belt to hold the image on the image member when the loop belt is electrified. This makes the loop belt as the primary transfer member, which can suck to firmly hold the image transferred from the image member, available for the image forming apparatus.

Further, the first belt member of the loop belt, which carries the recording medium, to which the image created on the image member by the developer on the basis of obtained image data from the outside is transferred and fixed, is made of the material that has the electric resistance enabling the loop belt to hold the recording medium when the loop belt is electrified. This makes the loop belt, which can suck to firmly hold the transferred recording medium, available for the image forming apparatus. As described so far, according to the invention, each loop belt can hold the recording medium on transfer or the developer firmly, thus provides the image forming apparatus that forms an image accurately at a prescribed position.

In the present invention, the loop belt is formed by fusing and splicing together the belt members made of different materials, which enables the precise formation of the loop belt in a conventional melt-splicing process.

The above and further objects and features of the invention will more fully be apparent from the following detailed description with the accompanying drawings.

DETAILED DESCRIPTION OF THE INVENTION

Figure 1:
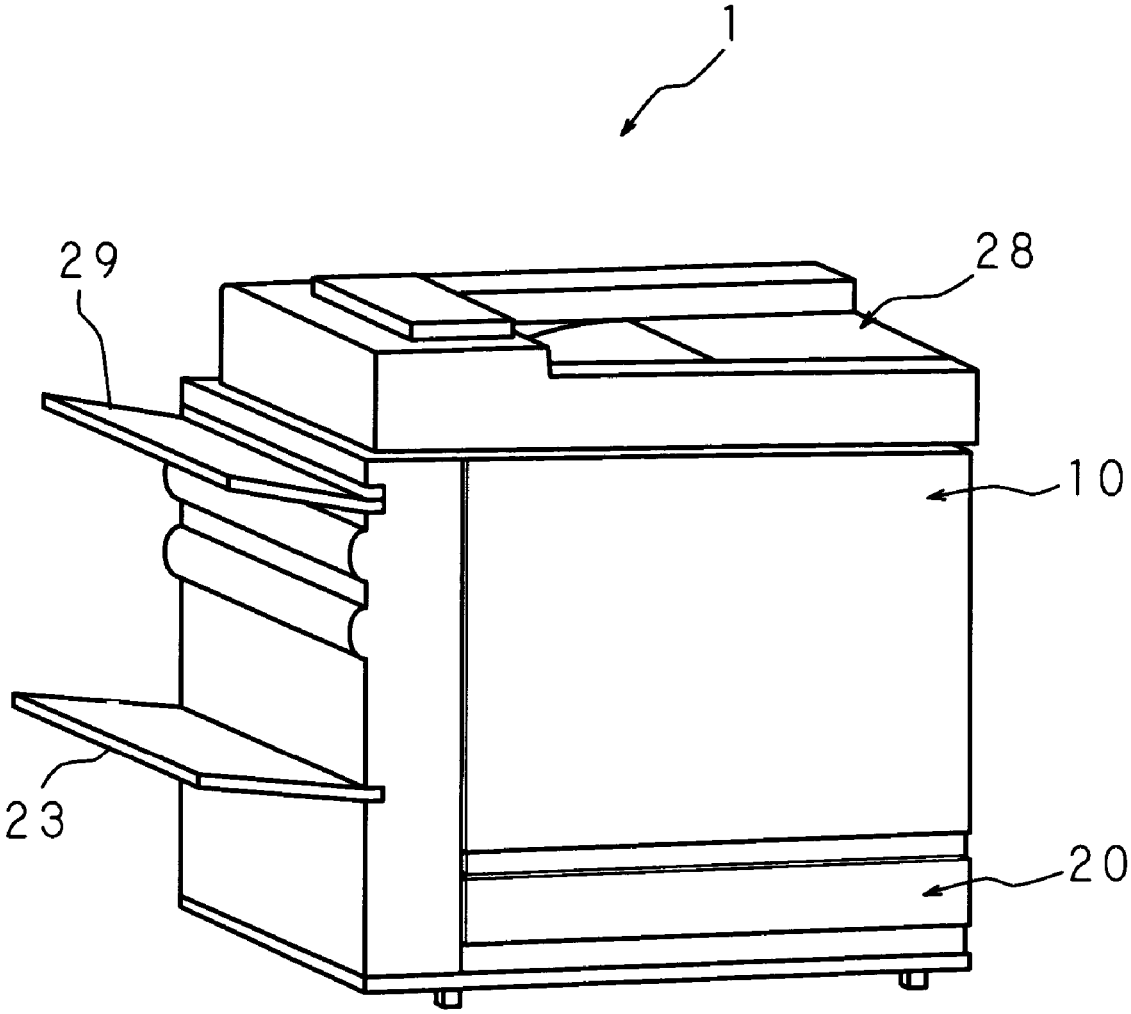
FIG. 1 is a perspective view showing the appearance of the image forming apparatus according to the present invention.

The following is a detailed description of the invention, which is given referring to the drawings for showing the embodiments of the invention.

Embodiment 1

FIG. 1 is the perspective view showing the appearance of the image forming apparatus according to the present invention. In the figure, the image forming apparatus according to embodiment 1 is symbolized with 1, and is actually a digital color printer. The image forming apparatus 1 has a drawer type paper-feeding cassette 20 on the lower part thereof, where the cassette 20 has a containing section 22 (see FIG. 2), which stores sheets (recording media), such as recording paper or OHP (Over Head Projector) sheets. The containing section 22 is opened when a user draws the paper-feeding cassette 20 to the user's side, and can be refilled with sheets while it is open.

The image forming apparatus 1 also has an image forming section 10 in the center thereof The image forming section 10 forms an image, which is based on image data obtained from the outside, on a sheet carried from the paper-feeding cassette 20. On the left side of the image forming section 10, a manual-feeding tray 23, on which a few sheets are placed, is attached. A sheet placed on the manual-feeding tray 23 is also fed into the image forming section 10, which forms an image on that sheet. The image forming apparatus 1 further includes paper-ejecting trays (ejecting section) 28, 29, to which a sheet bearing an image formed at the image forming section 10 is ejected, and an operating panel 105 (see FIG. 3) for a user to operate the image forming apparatus 1. The paper-ejecting trays 28, 29 and the operating panel 105 are arranged on the upper part of the image forming apparatus 1.

The image forming apparatus 1 may be provided also with units other than the above units, such as a paper-feeding cassette capable of storing a plurality of types of sheets different in size, a large-capacity paper-feeding cassette capable of storing several thousands of sheets, a plurality of paper-ejecting trays, a carrier mechanism for carrying a sheet bearing a formed image to each paper-ejecting tray, and so forth. These units can be attached to the image forming apparatus 1 as optional functions.

Figure 2:
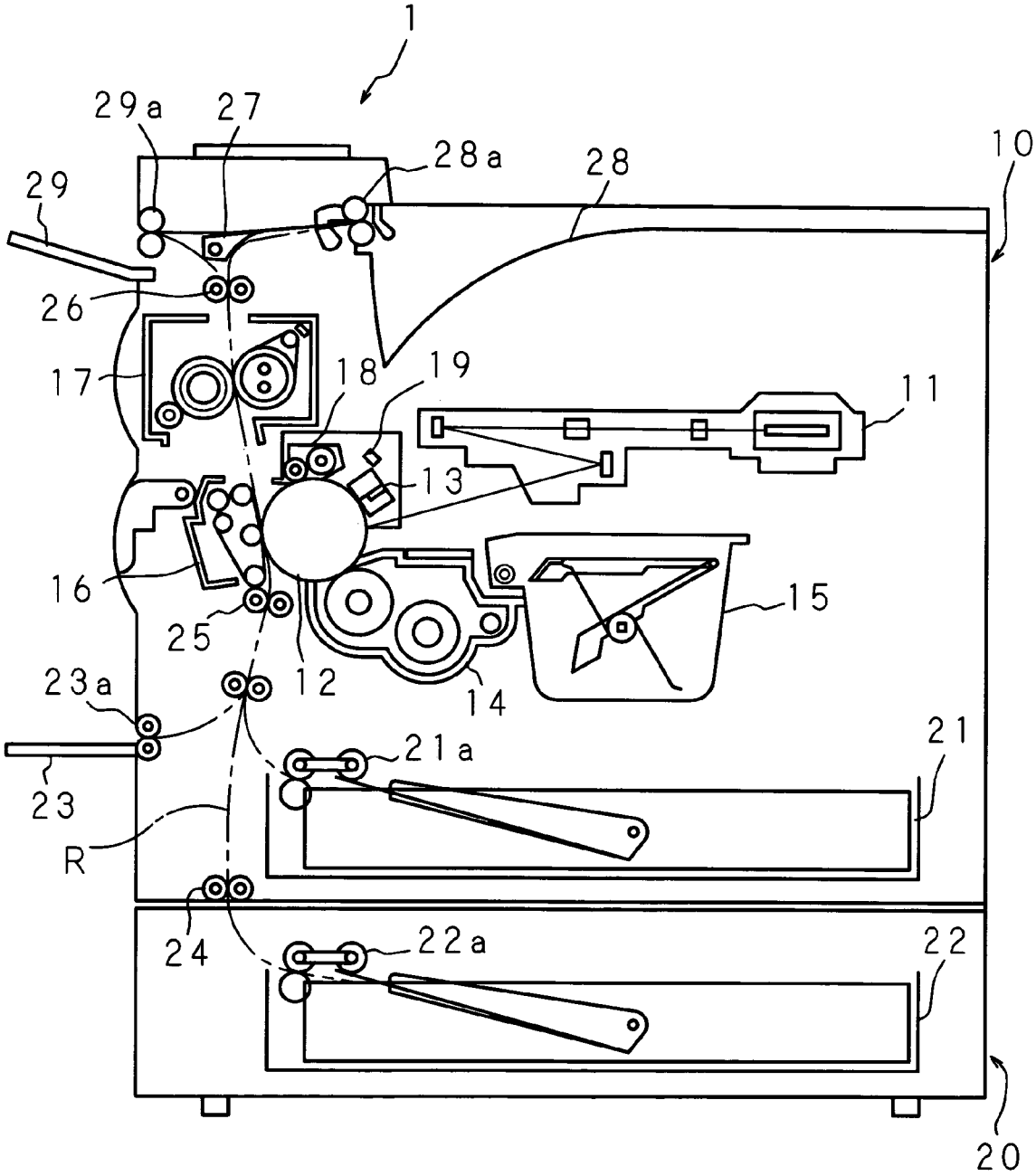
FIG. 2 is a longitudinal sectional view showing an instance of the internal structure of the image forming apparatus according to embodiment 1.

FIG. 2 is the longitudinal sectional view showing an instance of the internal structure of the image forming apparatus 1 according to embodiment 1. The image forming apparatus 1 forms an image on a sheet according to a printing job assigned by an external information processor (no drawing), such as a personal computer, that is connected to the image forming apparatus 1. According to embodiment 1, the image forming section 10 of the image forming apparatus 1 includes an optical scanning unit 11, a photosensitive drum 12, an electrifier 13, a developing unit 14, a transfer unit 16, and a fixing unit 17. The image forming section 10 forms (prints) an image on a sheet by an electrophotographic method.

The electrifier 13 electrifies the surface of the photosensitive drum 12 (image member) uniformly to give it a prescribed potential. Different types of electrifiers may be used as the electrifier 13, such as a roller type and a brush type, which are arranged to be in contact with the photosensitive drum 12, and a charger type, which is arranged not to be contact with the photosensitive drum 12. The image forming apparatus 1 shown in FIG. 2 is equipped with a charger type electrifier as the electrifier 13, which electrifies the surface of the photosensitive drum 12 negatively.

The optical scanning unit 11 has a laser scanning unit (LSU) having a laser irradiating section and a reflector, according to this embodiment. Instead of the USL, the optical scanning unit 11 may have a write-in head composed of an array of luminous elements, such as EL (Electro Luminescence) or LED (Light Emitting Diode).

The optical scanning unit 11 irradiates the surface of the photosensitive drum 12, which is electrified by the electrifier 13, with a laser beam to eliminate minus charges on the photosensitive drum 12. Specifically, the optical scanning unit 11 irradiates the photosensitive drum 12 with the laser beam, according to image data forwarded from an image memory 104 (see FIG. 3) to the optical scanning unit 11, to form the static latent image corresponding to the image data on the photosensitive drum 12.

The developing unit 14 takes a developer out of a developer supply container 15 next to the developing unit 14, and electrifies the developer negatively, then supplies the developer to the static latent image formed on the photosensitive drum 12. The developer, which is electrified negatively, is sucked to stick to the part of the photosensitive drum surface where minus charges are eliminated by the laser beam. This visualizes the static latent image on the photosensitive drum 12 to form a developed image (image created by the developer). Thus the developing unit 14 works as a unit that forms such a developed image.

The transfer unit 16 applies a high voltage, which has a polarity (positive) reverse to the charge polarity (negative) of the developer, to an incoming sheet. This causes the developed image formed on the photosensitive drum 12 to be transferred to the sheet, thus the transfer unit 16 works as a transfer section that transfers the developed image to the sheet. The transfer unit 16 may be different types of units employing different transfer methods, such as a corona transfer method, roller transfer method, brush transfer method, belt transfer method, or the like. The transfer unit 16 employing the belt transfer method is used in the image forming apparatus 1 shown in FIG. 2. The further details of the transfer unit 16 will be described later referring to FIG. 4.

The fixing unit 17 works as a fixing section that fixes the developed image, which is transferred to the sheet by the transfer unit 16 but is not fixed yet, to the sheet by heat and pressure. A unit employing a roller fixing method, a belt fixing method, and the like is available as the fixing unit 17. The fixing unit 17 employing the belt fixing method is used in the image forming apparatus 1 shown in FIG.2.

The photosensitive drum 12 is surrounded with the electrifier 13, the developing unit 14, and the transfer unit 16.

The photosensitive drum 12 is further surrounded with a cleaning unit 18 that recovers and eliminates the developer remaining on the surface of the photosensitive drum 12 after the developed image visualized on the drum surface has been transferred to the sheet, and with a neutralizing lamp 19 that removes charges on the surface of the photosensitive drum 12.

The image forming apparatus 1 has a containing section 21 for storing sheets on the lower part of the image forming section 10, in addition to the containing section 22 arranged inside the paper-feeding cassette 20. The containing section 21, the containing section 22, and the manual-feeding tray 23 have pick-up rollers 21*a*, 22*a*, 23*a*, respectively, which are placed near the front end of respective stacked sheets. Each of the pick-up rollers 21*a*, 22*a*, 23*a* separately picks a sheet and sends the sheet into the image forming section 10 through a carrier passage R. The pick-up roller 22*a* separately picks the sheet stored in the containing section 22 and sends the sheet to carrier rollers 24, which then send the sheet into the image forming section 10.

Each sheet separately fed by the pick-up rollers 21*a*, 22*a*, 23*a*, is further carried to resist rollers 25, which are arranged upstream to the transfer unit 16, via the carrier passage R. A pre-resist detecting switch (not shown) is set near the resist rollers 25, and makes the resist rollers 25, which stop rotating, hold the incoming sheet for a while to match the position of the developed image on the photosensitive drum 12 to that of the sheet to be further transferred. The detecting switch then allows the resist rollers 25 to start rotating at a given timely point to carry the sheet to the position where it is counter to the photosensitive drum 12. When the sheet reaches the counter position to the photosensitive drum 12, the transfer unit 16 transfers the developed image on the photosensitive drum 12 to the sheet.

The sheet transferred the developed image by the transfer unit 16 is then sent to the fixing unit 17, which applies heat and pressure to the sheet to fix the transferred image to the sheet by heat. The sheet with the fixed developed image is then carried to a changeover guide 27 by carrier rollers 26, and further proceeds to either of the branched paths of the carrier passage R, where the route of carrier is changed to two directions by the changeover guide 27. The sheet then passes through either of the branched paths via paper-ejecting rollers 28*a* or 29*a* to be ejected out to paper-ejecting trays 28 or 29. The sheet bearing the finished image is ejected to the paper-ejecting tray 28, with the sheet front face set downward, while to the paper-ejecting tray 29, with the sheet front face set upward.

Figure 3:
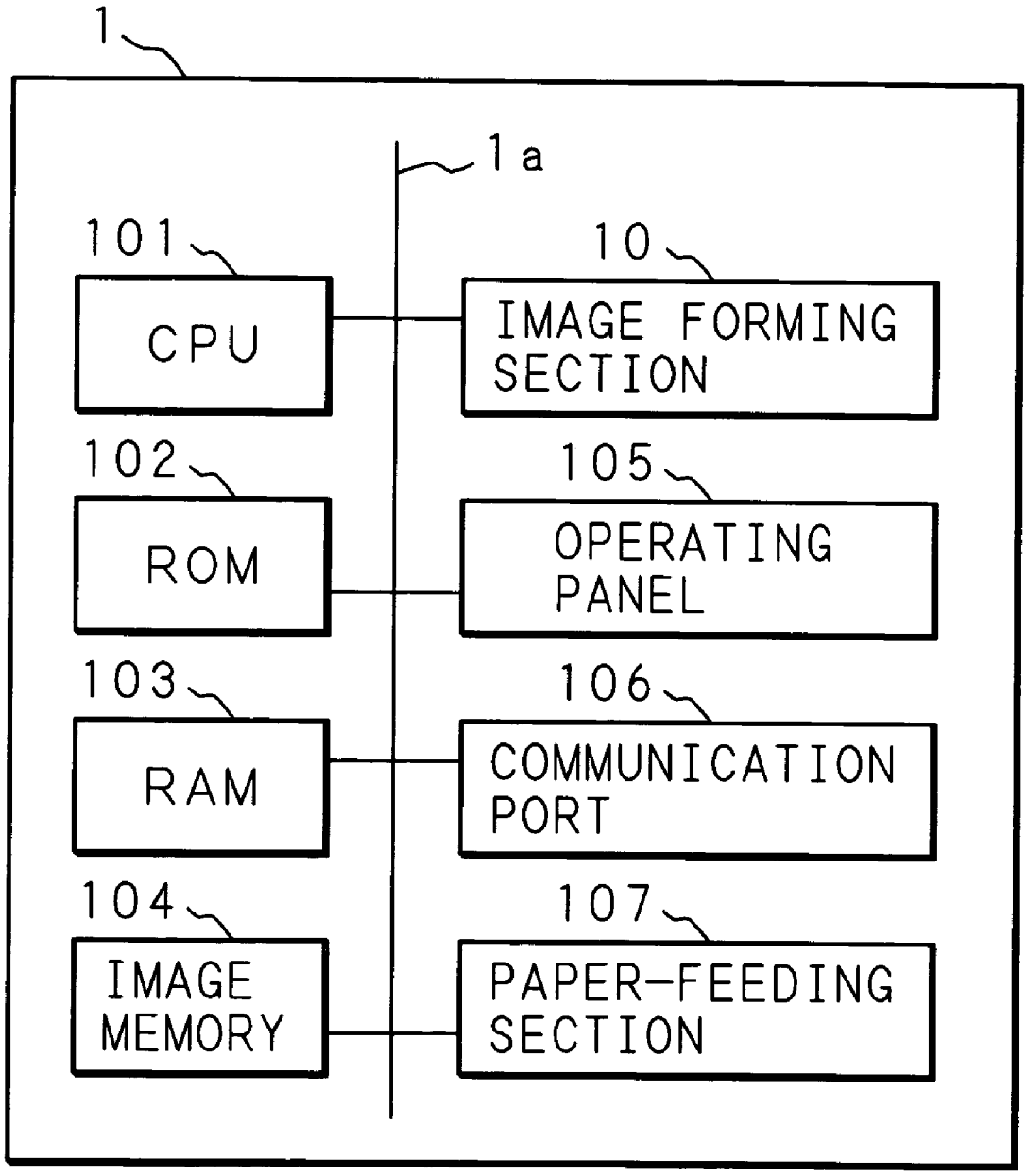
FIG. 3 is a block diagram showing an instance of the structure of a control system of the image forming apparatus according to embodiment 1.

FIG. 3 is the block diagram showing an instance of the structure of the control system of the image forming apparatus 1 according to embodiment 1. The image forming apparatus 1 has a CPU 101, to which several hardware components are connected via a bus 1 a. The hardware components includes a ROM 102, a RAM 103, the image memory 104, the operating panel 105, a communication port 106, a paper-feeding section 107, and the image forming section 10. The image forming apparatus 1 is also provided with a power supply unit (not shown), which supplies the hardware components with power to actuate them.

The ROM 102 stores a control program for the CPU 101 to control each hardware component. The RAM 103 is a volatile semiconductor memory, and temporarily memorizes the data that is generated during the execution of the control program by the CPU 101. The CPU 101 reads the control program out of the ROM 102, puts the program into the RAM 103 for temporary storage, and executes it sequentially to bring the image forming apparatus 1 into operation.

The image memory 104 is a volatile semiconductor memory, and temporarily memorizes the image data for printing that is obtained by processing a printing job sent through the communication port 106. The memorized image data is read by the image forming section 10 at a timely point specified by the CPU 101, and is sent out to the optical scanning unit 11 of the image forming section 10. The operating panel 105 includes an operating part, which has a variety of operating buttons for receiving operation commands from a user, and a display part, which consists of a LED display, a liquid crystal display, or the like, that displays necessary information for the user.

The communication port 106 has a communication interface for connecting an external information processor, such as a personal computer, to the communication port. The communication port 106 receives a printing job from the information processor that is connected to the communication port 106 via a communication cable or a communication network and sends necessary information to the information processor, thus controlling in the transmission/reception of various pieces of information.

The paper-feeding section 107 includes the containing sections 21, 22 and the manual-feeding tray 23, and drives the pick-up roller 21*a*, 22*a*, or 23*a* at a timely point specified by the CPU 101 to separately feed the sheets stacked in the containing sections 21, 22 and the manual-feeding tray 23 one by one to the image forming section 10. The image forming section 10 includes the optical scanning unit 11, the photosensitive drum 12, the electrifier 13, the developing unit 14, the transfer unit 16, the fixing unit 17, and the cleaning unit 18. The image forming section 10 forms an image on the sheet fed by the paper-feeding section 107, according to the image data that is forwarded from the image memory 104.

Figure 4:
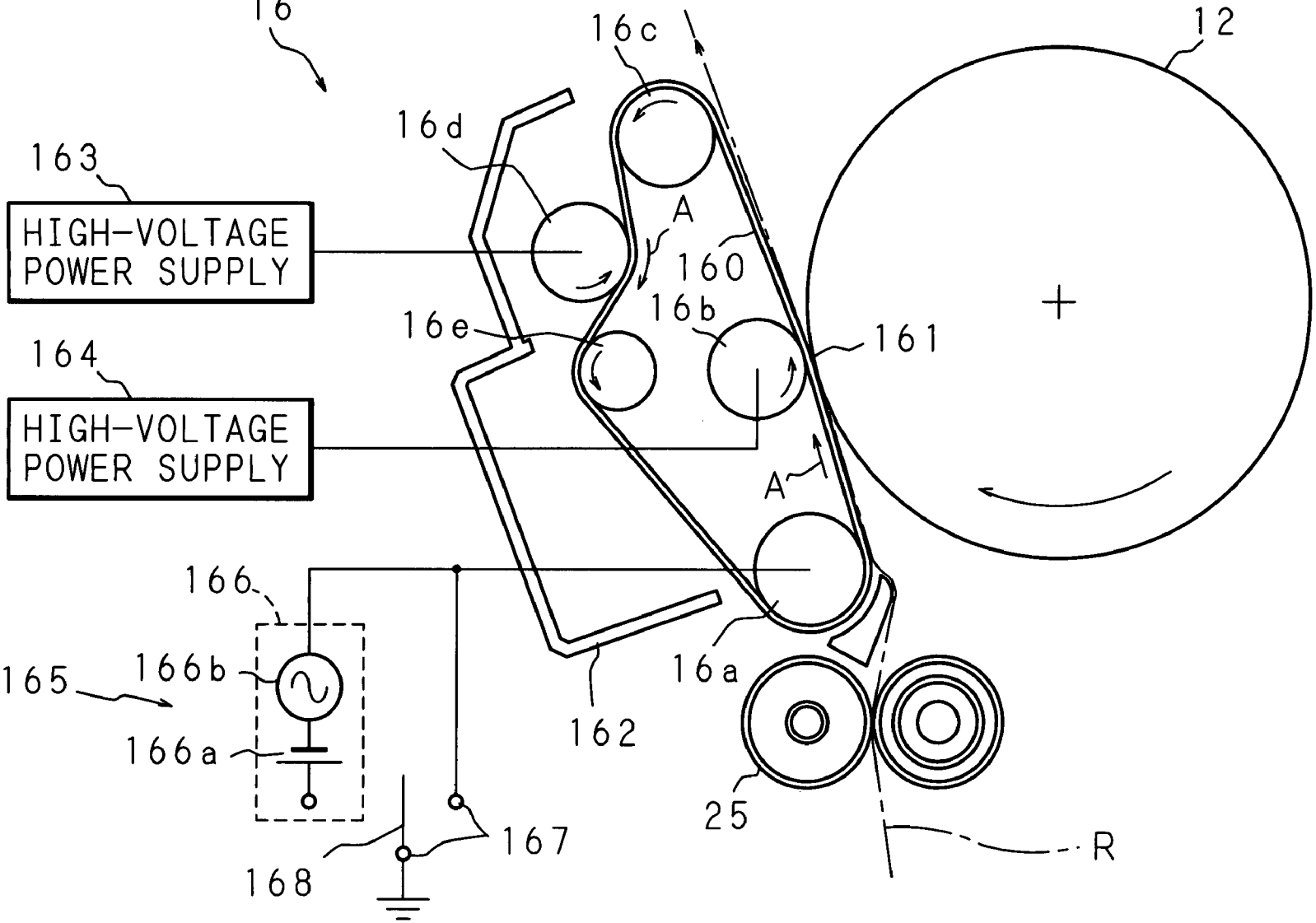
FIG. 4 is a longitudinal sectional view showing an instance of the structure of a transfer unit.
Figure 5:
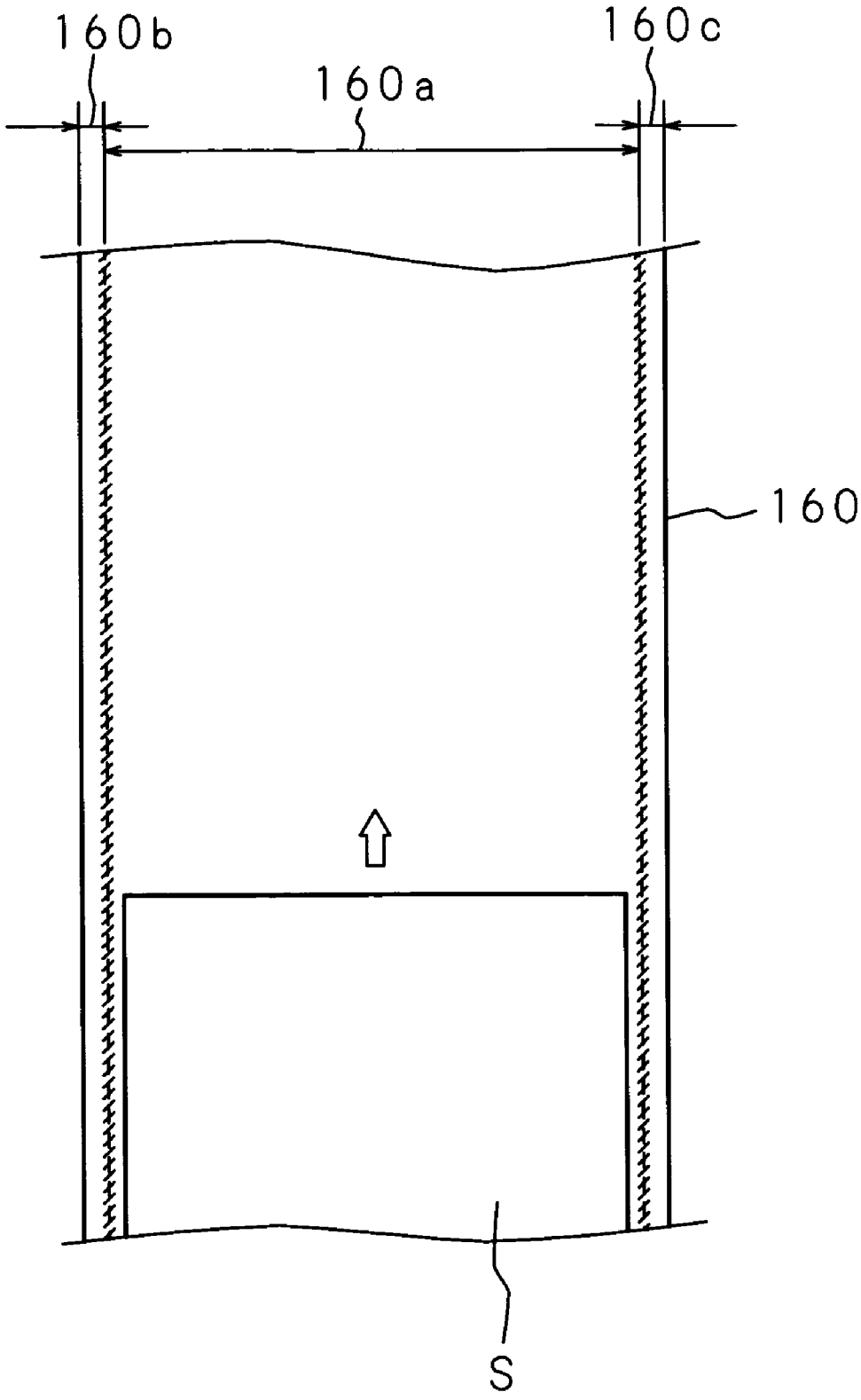
FIG. 5 is a simplified top view for explaining the structure of a transfer belt of the transfer unit.

The following is a description of the structure of the transfer unit 16 in the image forming section 10 of the image forming apparatus 1 according to embodiment 1. FIG. 4 is the longitudinal sectional view showing an instance of the structure of the transfer unit 16, and FIG. 5 is the simplified top view for explaining the structure of the transfer belt 160 of the transfer unit 16.

As shown in FIG. 4, the transfer unit 16 includes a loop transfer belt 160, a transfer belt driven roller 16*a*, a transfer roller 16*b*, which is in contact with the photosensitive drum 12 via the transfer belt 160, a transfer belt driving roller 16*c*, a transfer belt cleaning roller 16*d*, a transfer belt tension roller 16*e*, and a developer recovery container 162. The transfer belt 160 is stretched over each roller 16*a*, 16*b*, 16*c*, 16*d*, 16*e*, and runs in rotation in the arrowed direction A shown in FIG. 4 as each roller 16*a*, 16*b*, 16*c*, 16*d*, and 16*e* drives the transfer belt 160.

The transfer belt driving roller 16*c* is driven by a roller driving circuit ( not shown) to rotating counterclockwise in a front view of FIG. 4, thus rotates the transfer belt 160 in the arrowed direction A. The transfer belt driven roller 16*a* is a rotary roller, which rotates in following the rotation of the transfer belt 160 caused by the driving roller 16*c*. The driven roller 16*c* is connected to a potential adjusting circuit 165, and adjusts the charge potential of the transfer belt 160 in a contact area where the driven roller 16*a* is in contact with the transfer belt 160. Hence the driven roller 16*a* works as an electrifying section that electrifies the transfer belt 160, which transfers a sheet to which a developed image is transferred from the photosensitive drum 12.

The potential adjusting circuit 165 includes a voltage applying circuit 166, a grounded circuit 167, and a switchover circuit 168. The voltage applying circuit 166 consists of a DC power supply 166*a* and an AC power supply 166*b*, which are connected in series, and applies a voltage, which is created by superposing an AC bias of the AC power supply 166*b*, on a DC bias of the DC power supply 166*a*, to driven roller 16*a*. According to the embodiment 1, the voltage applying circuit 166 superposes an AC voltage having a frequency of 50 Hz to 2.0 kHz and a peak-to-peak voltage of 4.0 to 4.5 V on a DC voltage of−100V to create the superposed voltage that is applied to the driven roller 16*a*.

The grounded circuit 167 grounds the driven roller 16*c* according to need. The switchover circuit 168 is controlled by the CPU 101 (see FIG. 3) to connect either the voltage applying circuit 166 or the grounded circuit 167 to the driven roller 16*a*, according to the charge condition of the sheet, for example, on the basis of a detection result given by a sheet type detecting sensor and a humidity detecting sensor.

The transfer roller 16*b* has a base of a metal shaft having a diameter of 8 to 10 mm, and the metal shaft is coated with a conductive elastic material, such as an EPDM (Ethylene Propylene Diene Monomer, or ethylene propylene rubber) or an expanded urethane. The transfer roller 16*b* is connected to a high-voltage power supply 164, and applies a transfer bias to a contact part 161 between the photosensitive drum 12 and the transfer belt 160, where the conductive elastic material on the transfer roller surface comes in contact with the photosensitive drum 12 via the transfer belt 160.

The transfer belt cleaning roller 16*d* is in contact with a given part of the surface of transfer belt 160 that sucks to hold the sheet thereon. The outer circumferential surface of the cleaning roller 16*d* moves in reverse to the moving direction of the outer circumferential surface of the transfer belt 160 on the contact part between the cleaning roller 16*d* and the-transfer belt 160, where the developer sticking to the transfer belt 160 is removed as the outer circumferential surface of the cleaning roller 16*d* rubs on that of the transfer belt 160. The developer that is removed from the transfer belt 160 by the cleaning roller 16*d* drops into the developer recovery container 162 to be recovered.

The cleaning roller 16*d* is connected to a high-voltage power supply 163, which supplies the cleaning roller 16*d* with power so that the cleaning roller 16*d* applies a voltage, which is reverse in polarity (negative 1 kV or so) to the transfer bias applied to the transfer belt 160 by the transfer roller 16*d*, to the transfer belt 160. The applied voltage by the cleaning roller 16*d* brings the charge potential of the transfer belt 160 into positive one close to neutral, which makes efficient the removal of the residual developer from the transfer belt 160

The transfer belt 160 is a film of 100 to 150 μm in thickness, which is made of a conductive material that is formed into a loop shape in an extrusion molding or centrifugal molding process. According to embodiment 1, the transfer belt 160, with a transfer belt 160 sucked and held thereon, runs in rotation in the arrowed direction shown in FIG. 5 to carry the sheet S. The sheet S is formed by splicing belt members made of different materials in the width direction that cross the transfer direction of the sheet S. As shown in FIG. 5, the transfer belt 160 consists of a first belt member 160*a* formed in the lateral center of the transfer belt 160 and second belt members 160*b*, 160*c* formed on both sides of the first belt member 160*a*.

The first belt member 160*a* has a width slightly greater than the maximum width of a sheet S that may be carried by the transfer belt 160, for example, a width of 300 to 320 mm which is slightly longer than the longitudinal length of an A4 size sheet. The second belt members 160*b*, 160*c* each have a width of 10 to 20 mm. The width of the first belt member 160*a* can be altered according to an application of the image forming apparatus 1. For example, for an application of image formation on a sheet larger than an A4 type, the first belt member 160*a* is formed to have a width of 320 mm or more. Also, for handling only a sheet as large as a postal card, the first belt member 160*a* is formed to be 300 mm or narrower in width.

According to embodiment 1, the first belt member 160*a* of the transfer belt 160 transfers the sheet S sucked and held on the first belt member 160*a*. The first belt member 160*a*, therefore, must have an electric resistance that allows the belt member 160 to suck to hold the sheet S firmly through the charge potential given by the potential adjusting circuit 165, and be made of a material showing superior heat resistance. Accordingly, it is desirable that the first belt member 160*a* be made of, for example, an ethylene propylene rubber (EPDM: Ethylene-Propylene-Diene Monomer), a nitrile rubber (NBR: Acrylonitrile-Butadiene Rubber), or the like. A material having proper volume resistivity ($1.0\times10^{8}$to $1.0\times10^{11}$ Ωcm) and heat characteristics should be selected as the material of the first belt member 160*a* in a consideration of the voltage that is applied to the first belt member 160*a* from the potential adjusting circuit 165.

Meanwhile, the second belt members 160*b*, 160*c* of the transfer belt 160 must be made of a material that is highly resistant to ozone generated inside the image forming section 10 and is superior at least in bending crack resistance and ozone resistance to the first belt member 160*a*. Accordingly, it is desirable that the second belt members 160*b*, 160*c* be made of, for example, a silicon rubber (Si), a fluorocarbon rubber (FPM: Fluoroplastic Monomer), or the like. A proper material should be selected for the second belt members 160*b*, 160*c* in consideration of mechanical durability, electrical durability, ozone resistance, manufacturing cost, and the like.

In manufacturing the transfer belt 160, films of 100 to 150 μm in thickness are made using respective materials selected for the first belt member 160*a* and for the second belt members 160*b*, 160*c*. Then the film made of the material selected for the first belt member 160*a* is divided into divided films, each of which have a prescribed width of 300 to 320 mm and a prescribed length approximately two times the length of a sheet having a size making it printable in the image forming apparatus 1. Likewise, the film made of the material selected for the second belt members 160*b*, 160*c* is divided into divided films, each of which have a prescribed width of 10 to 20 mm and a prescribed length approximately two times the length of a sheet having a size making it printable in the image forming apparatus 1.

The two long sides of a divided film as the first belt member 160*a* are spliced to each one long side of two divided films as the second belt members 160*b*, 160*c*. In splicing these films made of different materials, the splicing spots between the films are melted and fused together in a hot melting method. In addition, after splicing the first belt member 160*a* and the second belt members 160*b*, 160*c* into one completed film, the longitudinal ends of the completed film are fused together to form the loop transfer belt 160.

According to the above manufacturing process, the first belt member 160*a* and the second belt members 160*b*, 160*c*, which are made of different materials, are spliced together into the transfer belt 160 having a uniform thickness. The completed transfer belt 160 consists of the first belt member 160*a* that shows superior performance in sucking the sheet S, and the second belt members 160*b*, 160*c* that have excellent ozone resistance and durability, thus the transfer belt 160 having a long life is provided.

Figure 6:
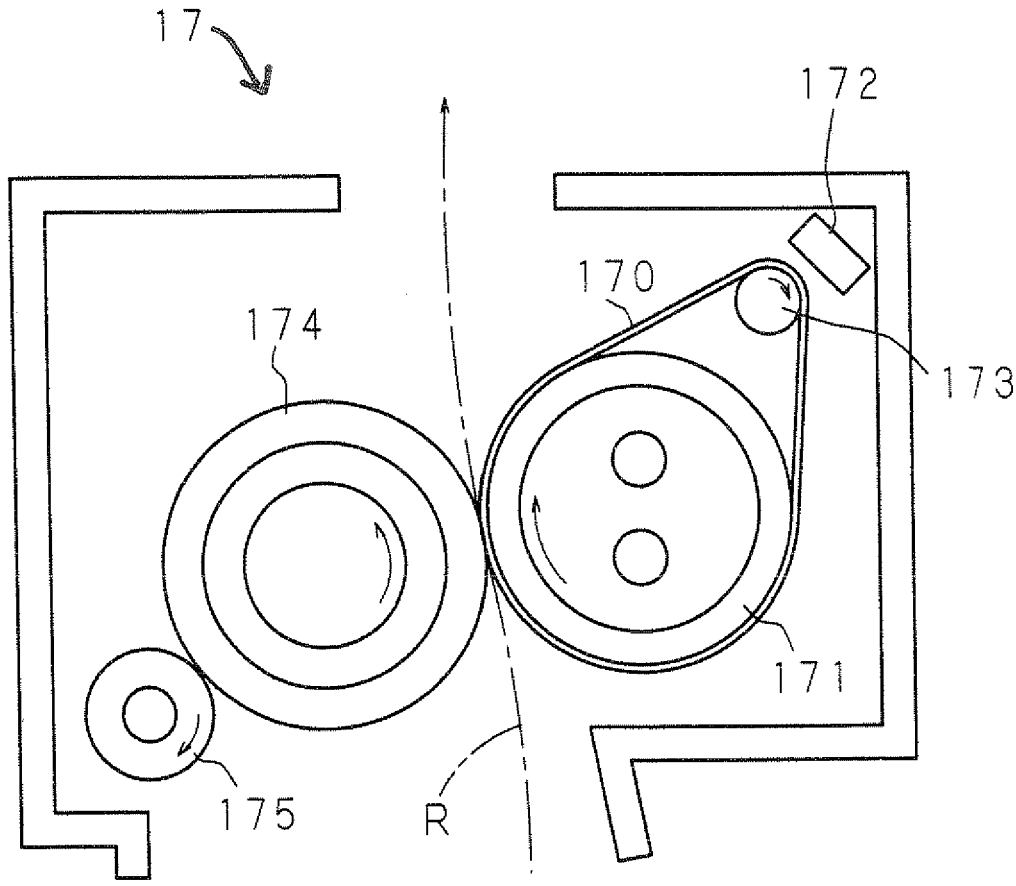
FIG. 6 is a longitudinal sectional view showing an instance of the structure of a fixing unit.

The loop belt used as the transfer belt 160 can also be used for the fixing unit 17, providing the material of the loop belt is changed. The following is a description of the structure of the fixing unit 17 in the image forming section 10 of the image forming apparatus 1 according to embodiment 1. FIG. 6 is the longitudinal sectional view showing an instance of the structure of the fixing unit 17.

As shown in FIG. 6, the fixing unit 17 includes a loop fixing belt 170, a fixing roller 171 for rotating the fixing belt 170, a driven roller 173, a pressure roller 174, a pressure auxiliary roller 175, and a heating unit 172. The fixing roller 171 is driven by a roller driving circuit (not shown) to rotate, for example, clockwise in a front view of FIG. 6, thus rotating the fixing belt 170. The driven roller 173 rotates in following the rotation of the fixing belt 170 by the fixing roller 171. The heating unit 172, which includes a heater lamp and a coil, is arranged in counter to the driven roller 173 across the fixing belt 170. The heating unit 172 heats a contact area between the fixing belt 170 and the driven roller 173 to a given fixing temperature.

Heated by the heating unit 172, the fixing belt 170 heats a sheet, which is transferred in through the carrier passage R, on a contact part between the fixing belt 170 and the pressure roller 174 as the fixing belt 170 is rotated by the fixing roller 171 and the driven roller 173. Meanwhile, the pressure roller 174 and the pressure auxiliary roller 175 apply a given pressure to the contact part between the pressure roller 174 and the fixing belt 170 in following control by the CPU 101 (see FIG. 3). Hence the incoming sheet, to which a developed image is transferred by the transfer unit 16, is heated by the fixing belt 170 under pressure between the fixing belt 170 and the pressure roller 174, where the developed image on the sheet is fixed by heat.

The fixing roller 171 has the same structure as the transfer belt driven roller 16*c*. That is, the fixing roller 171 is connected to a power supply (not shown), electrifying the fixing belt 170 to give it a charge potential adjusted through power supplied from the power supply. As a result, the sheet coming in through the carrier passage R is sucked to the fixing belt 170, and is made to pass through the contact part between the fixing roller 171 and the pressure roller 174 without fail. The fixing roller 171, therefore, works as an electrifying section that electrifies the fixing belt 170, which carries the sheet to which the transferred image is fixed.

In the above process, the sheet coming in through the carrier passage R should be subjected to the heat and pressure in a precise and certain manner. To make that happen, the fixing belt 170 must be made of such a material that has the proper electric resistance that enables the fixing belt 170 to suck and hold the sheet accurately while the fixing belt 170 electrified by the applied voltage from the fixing roller 171, and that has the proper heat resistance that makes the fixing belt 170 resistant to the heat applied by the heating unit 172. In addition, the lateral center and both sides of the fixing belt 170 are formed of respective different materials as in the case of the transfer belt 160 so that the fixing belt 170 is provided as a loop belt having higher durability.

Accordingly, it is desirable that the center portion of the fixing belt 170 be made of, for example, an ethylene propylene rubber (EPDM: Ethylene-Propylene-Diene Monomer), a nitrile rubber (NBR: Acrylonitrile-Butadiene Rubber), or the like. A material having proper volume resistivity and heat characteristics should be selected as the material of the center portion of the fixing belt 170 in consideration of the voltage applied by the fixing roller 171 and the heat applied by the heating unit 172. If heat resistance is emphasized in material selection, the softening point and the melting point of the developer have to be considered. Meanwhile, both lateral end portions of the fixing belt 170 must be made of a material that is highly resistant to ozone. Accordingly, both end portions are desirably be made of, for example, a silicon rubber (Si), a fluorocarbon rubber (FPM: Fluoroplastic Monomer), or the like. A proper material should be selected for both end portions in consideration of durability, ozone resistance, manufacturing cost, and the like.

The fixing belt 170 can be manufactured by the same manufacturing method employed for the transfer belt 160. As for the length of the fixing belt 170 in its running direction, it is sufficient for the fixing belt 170 to be long enough to be stretched between the fixing roller 171 and the driven roller 173 and allowed to rotate. The fixing belt 170, which is manufactured using the selected materials and method, consists of the center portion that shows superior performance in sucking the sheet and excellent heat resistance, and both end portions that have fine ozone resistance and durability, thus the fixing belt 170 having a long life is provided.

In the image forming apparatus 1, the loop belts are put in respective service along the carrier passage R, which extends from the sheet containing sections 21, 22 and the manual-feeding tray 23 to the ejecting trays 28, 29 to which the sheet bearing a formed image is ejected. Each loop belt is made of a specific material according to the location of arrangement of the belt so that the life of the loop belt is extended to be fit to the service at each location of arrangement. As a result, the cost of replenishing necessary consumables for the image forming apparatus 1 can be reduced.

Figure 7:
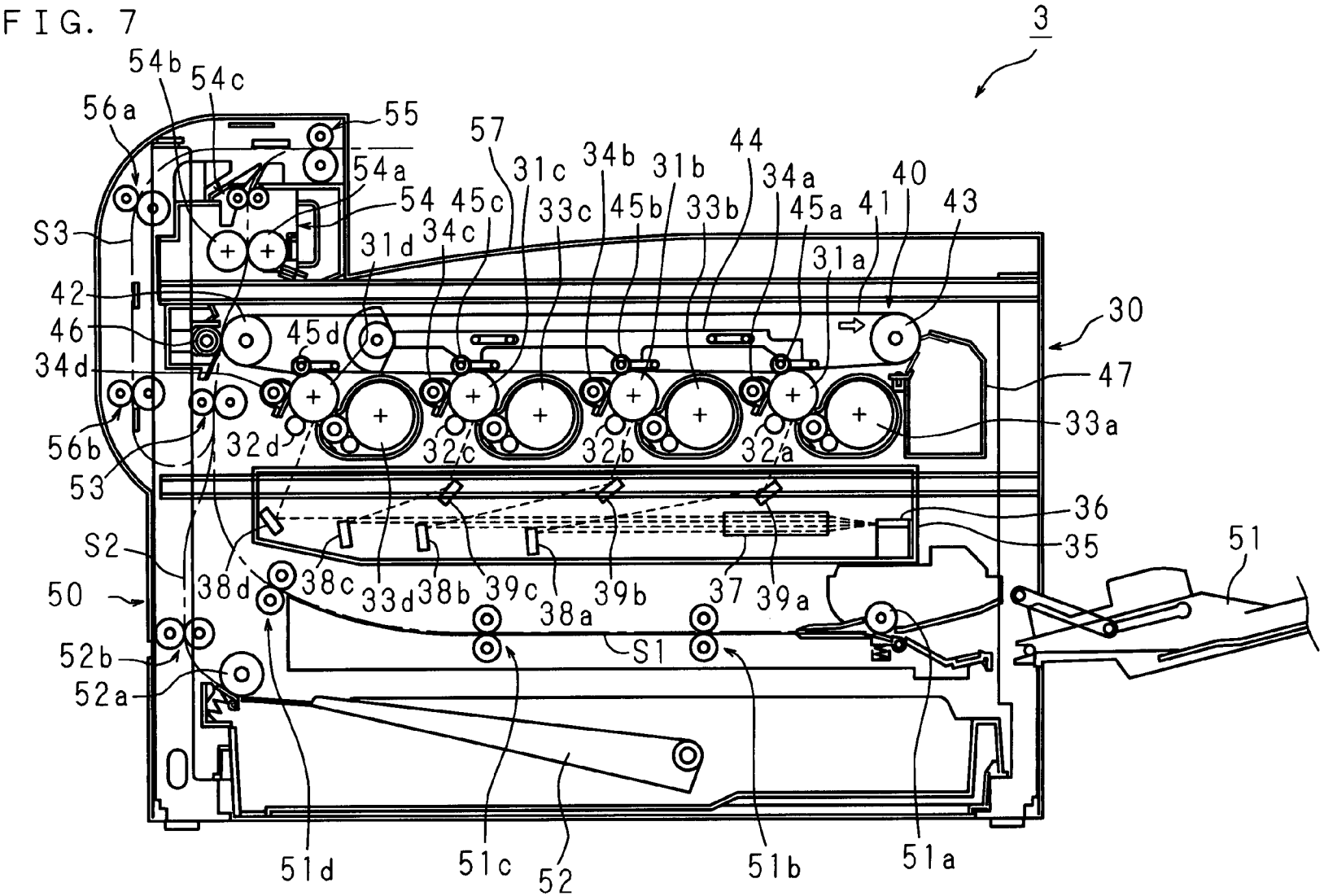
FIG. 7 is a longitudinal sectional view showing an instance of the internal structure of the image forming apparatus according to embodiment 2.

FIG. 7 is the longitudinal sectional view showing an instance of the internal structure of an image forming apparatus 3 according to embodiment 2. The image forming apparatus 3 is actually a digital color printer, and is mainly composed of an image forming section 30 and a paper-feeding section 50. The image forming apparatus 3 forms a multicolor image or a single color image on a sheet according to a printing job from an external information processor (not shown), such as a personal computer, which is connected to the image forming apparatus 3.

The image forming apparatus 3 has the image forming section 30 that works according to the electrophotographic method. The image forming section 30 forms a multicolor image using each color of yellow (Y), magenta (M), cyan (C), and black (K). To that end, the image forming section 30 has photosensitive drums 31*a*, 31*b*, 31*c*, 31*d*, which correspond to each color, electrifiers 32*a*, 32*b*, 32*c*, 32*d*, developing units 33*a*, 33*b*, 33*c*, 33*d*, cleaning units 34*a*, 34*b*, 34*c*, 34*d*, and an exposure unit 35, which emits a laser beam according to image data for printing to form a static latent image on each photosensitive drum 31*a*, 31*b*, 31*c*, 31*d*.

In representing each unit here, the symbols a, b, c, d are attached to the unit numbers in correspondence to yellow (Y), magenta (M), cyan (C), and black (K), respectively. In a notational consideration, however, each unit provided for each color will be represented collectively in a single form in the following description as a photosensitive drum 31, an electrifier 32, a developing unit 33, and a cleaning unit 34, except a case where a unit corresponding to a specific color is picked up for detailed description.

A roller type electrifier is employed as the electrifier 32 that is arranged to be in contact with the photosensitive drum 31. The electrifier 32 electrifies the surface of the photosensitive drum (image member) 31 uniformly to give it a prescribed potential. Instead of the roller type electrifier, a brush type electrifier or a charger type electrifier may be employed as the electrifier 32, which electrifies the surface of the corresponding photosensitive drum 31 negatively.

The exposure unit 35 has a laser scanning unit (LSU) having a laser irradiating section 36. The exposure unit 35 also includes a polygon mirror 37 and reflectors 38*a* to 38*d* and 39*a* to 39*c*, which guide the laser beam emitted from the laser irradiating section 36 to the photosensitive drum 31. Instead of the laser irradiating section 36, the exposure unit 35 may have a write-in head composed of an array of luminous elements, such as an EL or LED. The exposure unit 35 irradiates the surface of the photosensitive drum 31 with the laser beam according to received image data to form a static latent image on the photosensitive drum 31.

Each developing unit 33*a* to 33*d* stores a developer of each color of yellow, magenta, cyan, and black, electrifies the developer negatively, and supplies the developer to the static latent image formed on each photosensitive drum 31*a* to 31*d*. The developer, which is electrified negatively, is sucked to stick to the part of the photosensitive drum surface where minus charges are eliminated by the laser beam. This visualizes the static latent image on the photosensitive drum 31*a* to 31*d* to form each developed image (image created by the developer), thus the developing unit 33*a* to 33*d* works as a unit that forms a developed image in the above manner. The cleaning unit 34 recovers and eliminates the developer remaining on the surface of the photosensitive drum 31 after the image is transferred.

According to the image forming apparatus 3 of embodiment 2, the developed image on the photosensitive drum 31 is transferred by an intermediate transfer method to a sheet fed from the paper-feeding section 50. In the image forming apparatus 3, therefore, a transfer belt unit 40 is arranged above the photosensitive drum 31. The transfer belt unit 40 includes a transfer belt 41, a transfer belt driving roller 42, a transfer belt driven roller 43, a transfer belt tension mechanism 44, and intermediate transfer rollers 45*a*, 45*b*, 45*c*, 45*d*, which will be collectively represented as an intermediate transfer roller 45 in the following description.

The transfer belt 41 is stretched over the transfer belt driving roller 42, the transfer belt driven roller 43, the transfer belt tension mechanism 44, and the intermediate transfer rollers 45, and the driving roller 42 drives the transfer belt 41 to make it runs in rotation in the direction indicated by the white arrow (subscanning direction) shown in the figure. The driven roller 43 is connected to a power supply (not shown) electrifying the transfer belt 41 with power for generating a charge potential from the power supply to give the transfer belt 41 a prescribed potential on a contact part between the driven roller 43 and the transfer belt 41, thus transferring the developed image from the photosensitive drum 31 to the transfer belt 41. Hence the driven roller 43 works as an electrifying section that electrifies the transfer belt 41.

The transfer belt (primary transfer material) 41 is made of a film of 100 to 150 μm in thickness, formed into an loop shape, and in contact with the photosensitive drum 31 on the surface. Developed images in respective colors formed on the photosensitive drum 31 are transferred to the transfer belt 41, while they are placed on top of one another sequentially, to form a color developed image (multicolor developed image) on the transfer belt 41.

The intermediate transfer roller (first transfer section) 45, which is in contact with the back of the transfer belt 41, transfers the developed images from the photosensitive drum 31 to the transfer belt 41. The intermediate transfer roller 45 is supplied with a high-voltage transfer bias for transferring the developed images, that is, the high-voltage bias having the polarity (+) reverse to the charge polarity (−) of the developer. The intermediate transfer roller 45 has a base of a metal shaft, such as a stainless steel shaft, having a diameter of 8 to 10 mm, and is coated with a conductive elastic material, such as an EPDM or an expanded urethane. Through this conductive elastic material, the intermediate transfer roller 45 applies the high-voltage uniformly to the transfer belt 41.

The static latent images, which are developed in correspondence to each color on the photosensitive drum 31, are layered on the transfer belt 41, where the multicolor developed image as a printing image is created. This multicolor developed image, which is transferred to the transfer belt 41, is then transferred to a sheet by a transfer roller 46 (second transfer section) arranged at a contact point between the sheet and the transfer belt 41 through the rotation of the transfer belt 41.

Upon transferring the multicolor developed image to the sheet, the transfer belt 41 and the transfer roller 46 are put in pressure contact with each other to exert a given nipping force, while a voltage for transferring the multicolor developed image to the sheet, that is, the high-voltage having the polarity (+) reverse to the charge polarity (−) of the developer is applied to the transfer roller 46. To secure the constant nipping force acting between the transfer belt 41 and the transfer roller 46, either of the transfer belt driving roller 42 and the transfer roller 46 is made of a hard material, such as metal, and the other is made of a soft material, such as an elastic rubber, an expended resin, or the like.

The developer that is stuck to the transfer belt 41 through the contact between the photosensitive drum 31 and the transfer belt 41, or that remains on the transfer belt 41 as a result of a failure in the transfer to the sheet by the transfer belt roller 46, becomes the cause of the formation of mixed colors in the developer in the following process. Such a developer, therefore, is removed and recovered by a transfer belt cleaning unit 47 arranged near the transfer belt driven roller 43. The transfer belt cleaning unit 47 has a cleaning blade as a cleaning member that comes in contact with the transfer belt 41. A contact part between the cleaning blade and the transfer belt 41 is supported by the driven roller 43 on the back of the transfer belt 41.

The paper-feeding section 50 includes a manual-feeding tray 51 and a containing section 52, in which sheets for use in image formation (recording medium) are stored, respectively. The manual-feeding tray 51 is attached to the outer surface of the case of the image forming apparatus 3, and is used to place on the tray 51 a few sheets of specific types that are desired by a user and feeds them into the image forming apparatus 3. The containing section 52 is formed below the image forming section 30 and the exposure unit 35, and is used to store in the containing section 52 a number of sheets that have a size specified for the image forming apparatus 3 or a size preset by the user.

The sheet placed on the manual-feeding tray 51 is picked by a pick-up roller 51*a* in timing determined by a CPU (not shown) of the image forming apparatus 3, and is taken into the image forming apparatus, then is carried to the image forming section 30 by carrier rollers 51*b*, 51*c*, 51*d* that are arranged along a carrier passage S1. The sheet in the containing section 52 is separately picked and fed by a pick-up roller 52*a* one by one, and is carried to the image forming section 30 through carrier rollers 52*b* arranged along a carrier passage S2.

Resist rollers 53 are arranged under the transfer roller 46 and the transfer belt driving roller 42. The resist rollers 53 carries the sheet, which is carried from the paper-feeding section 50, to the transfer roller 46 in the timing that matches the front end of the sheet to that of a developed image on the transfer belt 41 so that the developed image is transferred to the sheet by the transfer roller 46.

The sheet transferred the developed image is then carried almost vertically, reaching a fixing unit 54 arranged above the transfer roller 46. The fixing unit 54 has a heating roller 54*a* and a pressure roller 54*b*. The fixing unit 54 controls a heating unit, such as a heater lamp, on the basis of a detected value of a temperature detector ( not shown) to keep the heating roller 54*a* at a prescribed fixing temperature, and makes the heating roller 54*a* and the pressure roller 54*b* pinch the sheet bearing the transferred developed image and roll over the sheet to fix the developed image to the sheet by the heat of the heating roller 54*a*. The sheet with the thermally fixed image is ejected out of the fixing unit 54 by carrier rollers 54*c* arranged near the exit of the fixing unit 54.

When single-side printing is demanded, the sheet passing through the fixing unit 54 is further sent through ejecting rollers 55, and is ejected to an ejecting tray 57, where the sheet is placed with its front face down. On the other hand, when double-side printing is demanded, the sheet exiting the fixing unit 54 is chucked with the paper-ejecting rollers 55, which are then made to rotate in reverse to send the sheet to a double-sided copy carrier passage S3, where carrier rollers 56*a*, 56*b* send the sheet back to the resist rollers 53. Leaving the resist rollers 53, the sheet proceeds to the preceding route, during which the developed image is transferred and fixed to the back face of the sheet by heat, and reaches the paper-ejecting rollers 55, which this time ejects the sheet to the ejecting tray 57.

Figure 8:
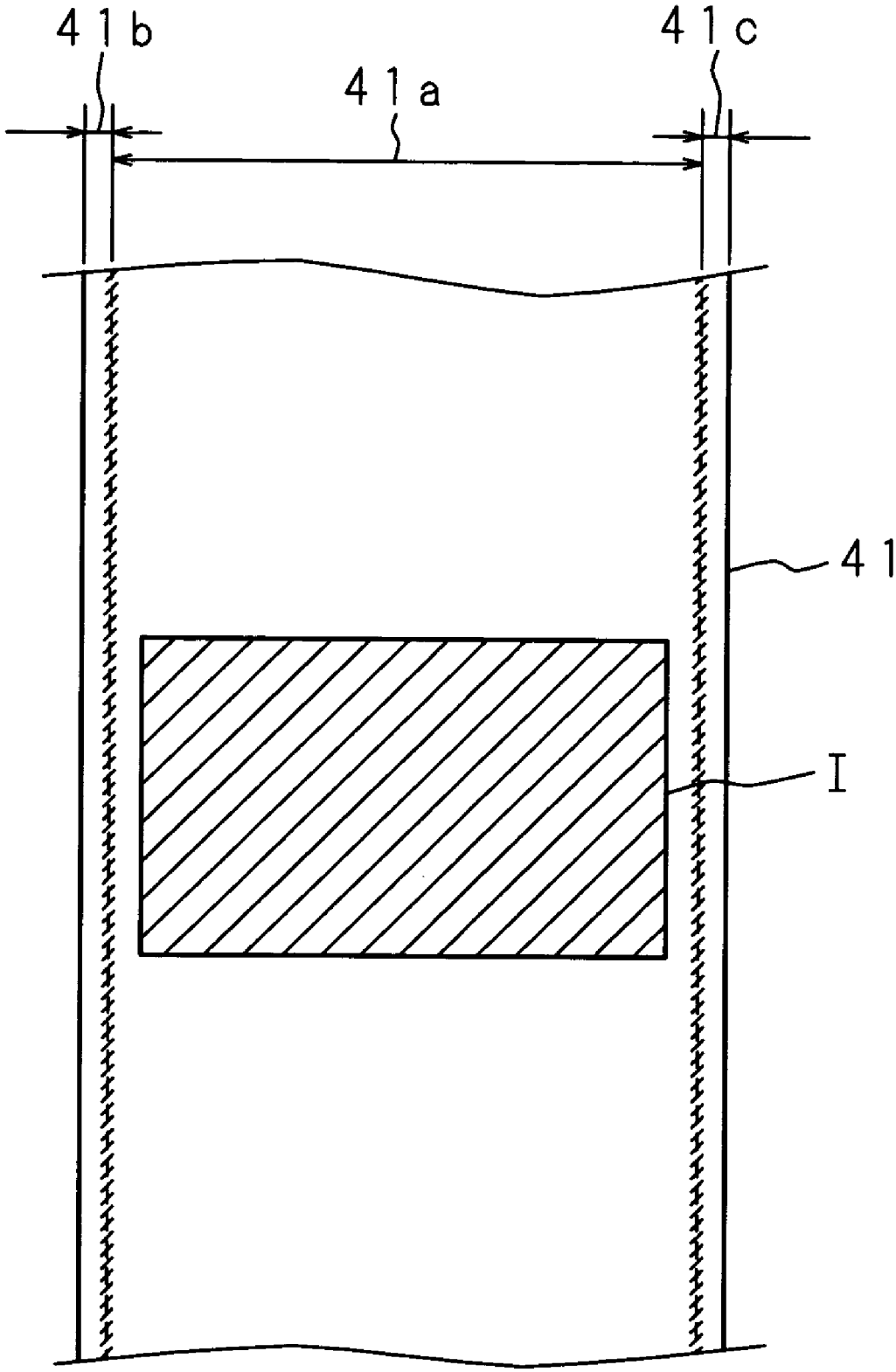
FIG. 8 is a simplified top view for explaining the structure of a transfer belt that is used in the image forming apparatus according to embodiment 2.

The following is a description of the structure of the transfer belt 41. FIG. 8 is the simplified top view for explaining the structure of the transfer belt 41 that is used in the image forming apparatus 3 according to embodiment 2. The transfer belt 41 is made of a film of 100 to 150 μm in thickness, and is formed into a loop shape using a conductive material. According to the embodiment 2, the transfer belt 41 holds a developed image I transferred from the photosensitive drums 31*a*, 31*b*, 31*c*, 31*d*, and carries the image I to the transfer roller 46.

The transfer belt 41 consists of a first belt member 41*a* formed in the lateral center of the transfer belt 41, and two second belt members 41*b*, 41*c* formed on both sides of the first belt member 41*a*, both first and second belt members 41*a*, 41*b*, and 41*c* being spliced together. The first belt member 41*a* has a width slightly greater than the maximum width of a developed image I that may be transferred to the transfer belt 41, for example, a width of 300 to 320 mm. The second belt members 41*b*, 41*c* have each width of 10 to 20 mm. The width of the first belt member 41 a can be altered according to an application of the image forming apparatus 3. For example, for an application of image formation on a sheet larger than an A4 type, the first belt member 41*a* is formed to have a width of 320 mm or more. Also, for handling only a sheet as large as a postal card, the first belt member 41*a* is formed to be 300 mm or narrower in width.

According to embodiment 2, the first belt member 41 a of the transfer belt 41 carries the developed image I held on the transfer belt 41. The first belt member 41*a*, therefore, must have an electric resistance that allows the transfer belt 41 to hold the developed image I firmly through the charge potential given by the transfer belt driven roller 43, and be made of a material showing superior heat resistance. Accordingly, it is desirable that the first belt member 41 a be made of, for example, an ethylene propylene rubber (EPDM: Ethylene-Propylene-Diene Monomer), a nitrile rubber (NBR: Acrylonitrile-Butadiene Rubber), or the like. A material having proper volume resistivity and heat characteristics should be selected as the material of the first belt member 41 a in consideration of the voltage that is applied to the first belt member 41 a from the intermediate transfer roller 45.

Meanwhile, the second belt members 41*b*, 41*c* of the transfer belt 41 must be made of a material that is highly resistant to ozone generated inside the image forming section 30 and is superior at least in bending crack resistance and ozone resistance to the first belt member 41*a*. Accordingly, it is desirable that the second belt members 41*b*, 41*c* be made of, for example, a silicon rubber (Si), a fluorocarbon rubber (FPM: Fluoroplastic Monomer), or the like. A proper material should be selected for the second belt members 41*b*, 41*c* in consideration of durability, ozone resistance, manufacturing cost, and the like.

The transfer belt 41 can be manufactured by the same manufacturing method employed for the transfer belt 160 as described with regard to embodiment 1. The transfer belt 41, which is manufactured by the same method, consists of the center portion that shows superior performance in sucking the sheet and excellent heat resistance, and both end portions that have fine ozone resistance and durability, thus the transfer belt 41 having a long life is provided.

While the above description of the preferred embodiments relates to a case where the image forming apparatus of the invention applies to a digital color printer, the image forming apparatus of the invention can also apply to a variety of image forming apparatuss having a series of functions of printing, copying, scanning, and faxing, and to combination equipment having those functions in combination. Also, while the above description relates to the structure of the image forming apparatus 1 according to embodiment 1, which has the transfer unit 16 working in a direct transfer method to form a monochromatic image, and of the image forming apparatus 3 according to embodiment 2, which has the transfer unit working in an intermediate transfer method to form a color image, the application of the loop belt used for the image forming apparatus of the invention is not limited to those transfer units. The loop belt can also be used for a transfer unit that transfers developed images formed on photosensitive drums corresponding to respective colors, which are arranged according to a tandem method, to a sheet on transfer in a sequential manner.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a loop belt for carrying a recording medium; and an image forming section that forms an image, which is based on image data obtained from outside the image forming apparatus, on the recording medium carried on the loop belt, wherein said loop belt is formed by splicing belt members made of different materials in the width direction thereof.

2. The image forming apparatus according to claim 1, wherein said loop belt is formed by splicing a first belt member, which is provided in the center of the width direction thereof, and second belt members, which are provided on both sides of the first belt member in the width direction and are made of a material different from that of the first belt member.

3. The image forming apparatus according to claim 2, wherein the first belt member has a width greater than that of the recording medium carried on the loop belt.

4. The image forming apparatus according to claim 2, wherein the second belt members are made of a material that is superior in bending crack resistance to the material of the first belt member.

5. The image forming apparatus according to claim 2, wherein the second belt members are made of a material that is superior in ozone resistance to the material of the first belt member.

6. The image forming apparatus according to claim 2, wherein the second belt members are made of a material that is superior in bending crack resistance and ozone resistance to the material of the first belt member.

7. The image forming apparatus according to claim 2, wherein a plurality of the loop belts are provided between a containing section that contains a recording medium and an ejecting section that ejects the recording medium on which is formed an image, and the first belt member of each loop belt is made of each different material according to the location of the alignment of the loop belt.

8. The image forming apparatus according to claim 2, wherein the image forming section forms an image, which is created by a developer electrified on the basis of the image data, on an image member.

9. The image forming apparatus according to claim 8, comprising:

a transfer section that transfers the image on the image member, which is formed at the image forming section, to the recording medium, and an electrifying section that electrifies the loop belt that carries the recording medium to which the image is transferred at the transfer section, wherein the first belt member of the loop belt is made of a material that has an electric resistance enabling the first belt member to hold the recording medium when the first belt member is electrified.

10. The image forming apparatus according to claim 8, comprising:

a first transfer section that transfers the image on the image member, which is formed at the image forming section, to a primary transfer member, a second transfer section that transfers the image transferred to the primary transfer member at the first transfer section to the recording medium, and an electrifying section that electrifies the primary transfer member to which the image is transferred at the first transfer section, wherein the primary transfer member is the loop belt, whose first belt member is made of a material that has an electric resistance enabling the first belt member to hold the image on the image member when the first belt member is electrified.

11. The image forming apparatus according to claim 8, comprising:

a transfer section that transfers the image on the image member, which is formed at the image forming section, to the recording medium, a fixing section that fixes the image transferred at the transfer section to the recording medium, and an electrifying section that electrifies the loop belt that carries the recording medium to which the image is fixed at the fixing section, wherein the first belt member of the loop belt is made of a material that has an electric resistance enabling the first belt member to hold the recording medium when the first belt member is electrified.

12. The image forming apparatus according to claim 1, wherein the loop belt is formed of the belt members made of different materials that are fused and spliced together.

* * * * *